United States Patent [19]

Mitani

[11] Patent Number: 4,666,322

[45] Date of Patent: May 19, 1987

[54] RECORD CARRIER FEED DEVICE

[75] Inventor: Masahiro Mitani, Nagoya, Japan

[73] Assignee: Brother Kogyo Kabushiki Kaisha, Japan

[21] Appl. No.: 767,407

[22] Filed: Aug. 20, 1985

[30] Foreign Application Priority Data

Aug. 20, 1984 [JP] Japan ..... 59-172599

[51] Int. Cl.[4] ..... B41J 13/03

[52] U.S. Cl. ..... 400/639; 400/645.4; 400/645.5

[58] Field of Search ..... 400/636.2, 636.1, 636, 400/636.3, 637.1, 638, 639, 639.1, 639.2, 642, 645, 645.1, 645.2, 645.3, 645.4, 645.5, 552

[56] References Cited

U.S. PATENT DOCUMENTS

| | | | |
|---|---|---|---|
| 2,555,728 | 4/1947 | Bradt | 400/639 X |
| 2,561,453 | 10/1947 | Von Duyke | 400/639.1 |
| 3,519,117 | 7/1970 | Smith | 400/636.2 X |
| 3,630,516 | 3/1970 | Hong | 271/120 |
| 3,669,447 | 9/1970 | Turner et al. | 271/120 |
| 3,937,455 | 4/1974 | Hauser | 271/120 |
| 4,062,436 | 4/1976 | Konder, Jr. et al. | 400/636 |
| 4,155,662 | 5/1979 | Maroth | 400/639.1 |
| 4,241,911 | 10/1979 | Lee | 271/314 |
| 4,379,646 | 3/1980 | Maeda | 400/636 |
| 4,437,780 | 3/1984 | Weber et al. | 400/636.1 X |
| 4,453,847 | 9/1982 | Smith | 400/645.5 |
| 4,525,089 | 6/1985 | Falconieri | 400/639.1 |

FOREIGN PATENT DOCUMENTS

| | | |
|---|---|---|
| 56-144983 | 11/1981 | Japan . |
| 59-68278 | 4/1984 | Japan . |

OTHER PUBLICATIONS

IBM Technical Disclosure Bulletin vol. 27, No. 1A, Jun. 1984, pp. 137–138, "Platen Mounted-Exit Feed Roll and Magnifying Deflector Assembly" by Williams.

*Primary Examiner*—Charles A. Pearson
*Attorney, Agent, or Firm*—Jones, Tullar & Cooper

[57] ABSTRACT

Disclosed is a record carrier feed device in which a guide bar is disposed in a position where the leading edge of a record carrier wound around a platen is on the point of separating from the cylindrical surface of the platen in a direction tangential thereto when the record carrier is to be fed past a printing region on the front side of the platen. The leading edge of the record carrier is guided along the guide bar to come into contact with guide rollers which are disposed on the proximal end side of the guide bar so that a fixed gap is defined between the guide rollers and the cylindrical surface of the platen. In the forward feed direction for the record carrier, the guide rollers rotate at a peripheral speed higher than that of the platen, exerting a frictional force in the forward feed direction on the record carrier. In the reverse feed direction, on the other hand, the guide rollers are kept from rotating, giving the record carrier a frictional force to pull back the same. The guide rollers are drivingly coupled to the platen, and a one-way clutch is provided between them for controlling the rotation of the guide rollers.

8 Claims, 7 Drawing Figures

RECORD CARRIER FEED DEVICE

BACKGROUND OF THE INVENTION

The present invention relates to a record carrier feed device for continuously feeding record media in the form of sheets of paper in contact with the peripheral surface of a platen into a printing region, and more specifically to a record carrier feed device adapted for use in typewriters or printers for electronic data processing systems or word processors.

Record carrier devices of this type are expected to serve to bring a record carrier moving along with a platen into intimate contact with the peripheral surface of the platen, that is, to protect the record carrier from dislocation or slacks or bulges, especially in a printing region.

To attain this, these conventional devices are provided with guide means for guiding the record carrier toward the platen while restraining the record carrier from tangentially separating from the platen at a position where the record carrier is fed upward after passing in a forward feed direction through the printing region in which a print head and the like are arranged, facing the front side of the platen.

In one such prior art record carrier feed device, as shown in FIGS. 1 and 2, the bottom portion of a platen 100 is surrounded by a paper pan 101 and front and rear feed rollers 102 and 103 supported by the paper pan 101. As the platen 100 rotates, the two feed rollers 102 and 103 transport the record carrier 104 in a forward feed direction as indicated by the arrows.

The record carrier 104 is fed upward through a printing region 105 which is defined between the platen 100 and a print head (not shown) opposed to the front side (right-hand side in FIG. 1) of the platen 10. Then, the record carrier 104 is held intimately against the platen 100 by guide rollers 106.

As shown in FIG. 2, the guide rollers 106 are rotatably supported at intervals on a shaft 107 which extends parallel to the platen 100. The shaft 107 is supported at both ends by swing arms 108, and the guide rollers 106 are urged to press on the platen 100 by springs 109 which are fixed individually on the arms 108. During the feeding of the record carrier 104, the swing arms 108 are in their operative position where they cause the guide rollers 106 to be pressed against the platen 100 by the urging force of the springs 109. At the time of the insertion of the record carrier 104 prior to the feeding operation, a solenoid 110 connected to the swing arms 108 is excited to move the swing arms 108 to an inoperative position indicated by two-dot chain lines in FIG. 1. As a result, the guide rollers 106 are disengaged from the platen 100, allowing the leading edge of the record carrier 104 to pass between the guide rollers 106 and the platen 100.

After preparations are made for the insertion of the record carrier 104, the solenoid 110 is deenergized to shift the guide rollers 106 from inoperative position to operative position, causing the leading edge of the record carrier 104 in the position indicated by two-dot chain lines to be pressed intimately against the platen 100. This arrangement may protect the record carrier 104 in the printing region 105 from dislocation, slacks, or bulges.

Disclosed in Japanese Patent Disclosure No. 56-144983 and FIGS. 1 and 2 of U.S. Pat. No. 4,453,847 are alternative examples of record carrier which, like the above-mentioned device, are constructed so that guide rollers are caused to abut against a platen during record carrier feeding.

In the prior art devices described above, the contact pressure of a plurality of guide rollers on the peripheral surface of the platen is subject to variations attributed to errors in accuracy. Accordingly, the pressure applied to the record carrier becomes uneven, exerting a bad influence upon the feeding accuracy. Structurally, moreover, it is difficult to adjust the pressure of the guide rollers for uniformity. Thus, the working accuracy of the guide rollers can be improved only in a limited manner.

According to the device of this type, furthermore, it is necessary to release the guide rollers from the platen with every record carrier insertion, requiring troublesome operation. Devices with an automatic record carrier insertion function absolutely require a solenoid or other shift mechanism for the guide rollers and other mechanisms associated therewith, resulting in a complicated construction and increased manufacturing cost.

These problems will be additionally serious if a printer with the record carrier feed device of this type is to be used for so-called graphic printing in which the rotation of the platen is controlled not only for the forward feed direction but for the reverse feed direction to effect printing of graphic patterns or diagrams on the record carrier on the platen.

In FIGS. 3 to 6 of U.S. Pat. No. 4,453,847, there is disclosed a feed arrangement in which a rotatable guiding member in the form of a paddle wheel having a number of resilient blades is mounted in interference relationship to a platen so that the blades serve to capture the leading edge of a record carrier and redirect it toward the platen.

This arrangement is not, however, very high in durability since the edges of the blades repeatedly strike against the platen and bend. If the guiding member rotates untimely, moreover, the blades will fail to capture the leading edge of the record carrier, and their edges will possibly reject or double the leading edge of the record carrier. Such a situation would produce nonnegligible noises.

SUMMARY OF THE INVENTION

The present invention is contrived in consideration of these circumstances, and is intended to provide a record carrier feed device which permits further stable and intimate contact between record carrier and platen without being influenced by component accuracy, which does not require any special, troublesome operation for the insertion of the record carrier, which enjoys an addition of an automatic insertion function for the record carrier without complicating the structure or increasing cost.

In order to achieve the above object, according to the present invention, guide roller means basically are disposed in a fixed position spaced from the peripheral surface of a platen with a gap of a predetermined size therebetween during record carrier feeding, and is rotated in a forward feed direction for a record carrier, at a peripheral speed higher than that of the platen. Thus, the record carrier in contact with the guide roller means is continually subjected to a frictional force or tractive force in the forward feed direction. As a result, the record carrier, especially in a printing region, can be kept in intimate contact with the platen. In this manner, slacks or bulges can positively be avoided in the printing region.

With this arrangement, the device of the present invention, unlike the prior art devices, is quite free from unevenness in the contact pressure of the guide rollers on the platen due to variations in accuracy. It is therefore unnecessary to take component accuracy specially into consideration.

According to the present invention, moreover, guide bar means is provided between the printing region and the guide roller means, whereby the record carrier is guided to the guide roller means. The leading edge of the record carrier fed in the forward feed direction past the printing region is caused to engage the guide bar means to be guided thereby toward the peripheral surface of the platen. After coming out of the printing region, therefore, the record carrier can smoothly reach the guide roller means. Thus, the record carrier is protected from any troubles in feeding, such as bending or excessive slacks or bulges.

In a preferred arrangement of the present invention, the guide roller means is driven through the medium of one-way clutch means. In the forward feeding of the record carrier, the clutch means is connected to cause the guide roller means to rotate, while, in the reverse feeding, the clutch means is disengaged to leave the guide roller means nonrotating. Thus, in the reverse feeding, the guide roller means applied to the record carrier a frictional force acting oppositely to the reverse feed direction. Also in this case, therefore, the intimate contact between the record carrier and te platen is ensured in the printing region.

In another preferred arrangement of the invention, the platen and the guide roller means are rotated in association with each other, and the one-way clutch means is disposed between the two. Thus, a common drive source may be used for the platen and the clutch means.

In a further preferred arrangement of the invention, the guide roller means and the guide bar means are supported on a common axis, so that they can be unitized for the ease of assembly.

Other objects and advantages of the present invention will be apparent from the following detailed description of an illustrative embodiment thereof.

BRIEF DESCRIPTION OF THE DRAWINGS

Referring now to FIGS. 3 to 7, a preferred embodiment of the present invention will be described in detail.

DETAILED DESCRIPTION OF THE PREFERRED EMBODIMENT

Figure 3:
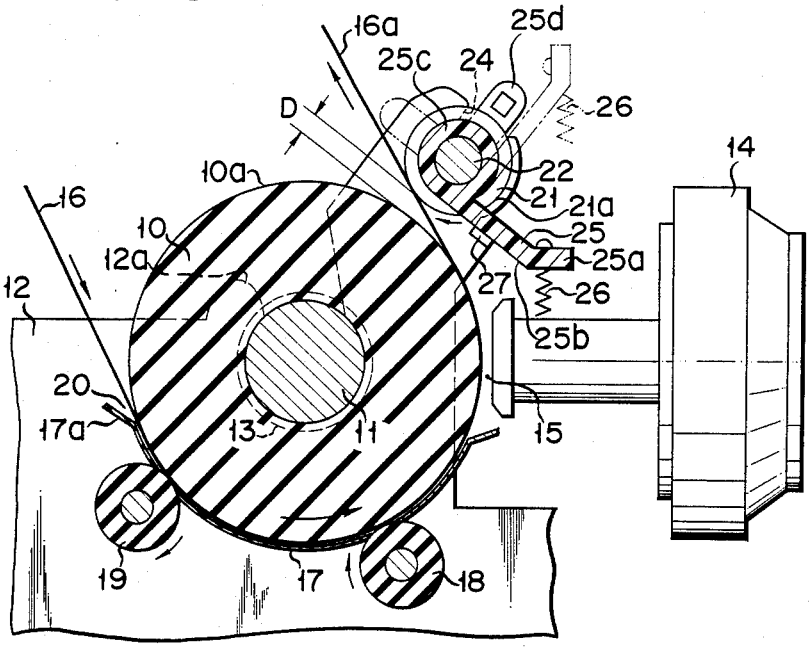
FIG. 3 is an enlarged vertical sectional view of a record carrier feed device according to the present invention taken along line 3—3 of FIG. 4.

In FIG. 3, a platen 10 of hard rubber having a cylindrical surface 10*a* is rigidly fixed on a shaft 11. The shaft 11 is rotatably supported in recesses 12*a* in a pair of printer side frames 12 by bearings 13. In the front side or right-hand side of FIG. 3, a print head 14 of a dot-matrix type faces the platen 10, defining a printing region 15 between the two.

A record carrier 16 in the form of a printing paper sheet is fed under the platen 10 and past the printing region 15 and then advanced upward to be wound around the platen 10. The forward feed direction of the record carrier is indicated by full-line arrows in FIG. 3.

In the region under the platen 10, there are arranged a paper pan 17 defining a path along which the record carrier is to be guided, and a front feed roller 18 and a rear feed roller 19 rotatably supported by the paper pan 17 and in sliding contact with the platen 10. An inlet aperture 20 for the record carrier 16 is defined between the platen 10 and the rear end 17*a* of the paper pan 17. The record carrier 16 inserted through the inlet aperture 20 is supported in intimate contact with the peripheral surface 10*a* of the platen 10 by the two feed rollers 18 and 19 so as to be advanced toward the printing region 15. The paper pan 17 and the feed rollers 18 and 19 have a conventional construction.

In the printing region 15, a conventional paper meter (not shown) is mounted on the print head 14, whereby the record carrier 16 is guided along the peripheral surface 10*a* of the platen 10.

Guide rollers 21 (only one shown in FIG. 3) constituting guide roller means are arranged above the platen 10, on the rear side of the printing region 15 in the forward feed direction of the record carrier 16. Each guide roller 21 has a peripheral surface 21*a* to be in frictional contact with the record carrier 16, and, like the platen 10, is formed from hard rubber for effective frictional resistance.

The guide rollers 21 are rigidly fixed on a guide shaft 22 parallel to the shaft 11, and are rotatable together with the shaft 22. A gap D of a predetermined size is defined between the roller peripheral surface 21*a* and its corresponding portion of the platen surface 10*a*.

The size of the gap D, which depends upon the size of other components, is preferably set at about 2.0 mm. In this case, the thickness of the record carrier 16 is supposed to range from 0.06 mm to 0.1 mm on the average and to 0.3 mm at the maximum.

Figure 4:
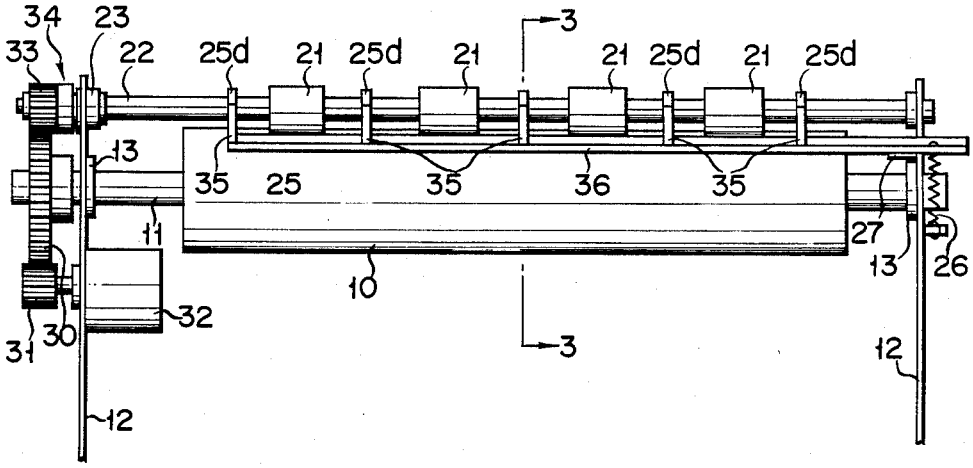
FIG. 4 is a top view of the device shown in FIG. 3.

The guide shaft 22 is rotatably supported in recesses 24 in the printer side frames 12 by bearings 23 (FIG. 4).

A guide bar 25 constituting guide bar means is disposed between the guide rollers 21 and the printing region 15. One end 25*a* of the guide bar 25 nearer to the printing region 15 extends diagonally downward. A smooth slanting surface 25*b* adapted to be in sliding engagement with the leading edge 16*a* of the record carrier 16 is formed at that portion of the guide bar 25 which faces the platen 10.

The slanting surface 25*b* serves to guide the leading edge 16*a* of the record carrier 16 toward the guide rollers 21.

The other end 25*c* of the guide bar 25 remote from the printing region 15 is supported on the guide shaft 22 so as to be rockable relatively thereto. Operating levers 25*d* for rocking the guide bar 25 are integrally formed at the other end 25*c*.

One end of a spring 26 is retained by the one end 25*a* of the guide bar 25 so that the guide bar 25 is continually urged by the urging force of the spring 25 to rock clockwise (FIG. 3) around the guide shaft 22. Normally, the guide bar 25 is held in its operative position as shown in full lines in FIG. 3 by a stopper 27 protruding from the side frame 12, resisting the urging force of the spring 26. The guide bar 25 is rockable between the operative position and its inoperative position shown in two-dot chain lines in FIG. 3, against the urging force of the spring 26. In this case, the operator can manually operate the guide bar 25 holding one of the operating levers 25*d*.

In the operative position, the guide bar 25 effectively accomplishes the aforesaid action on the record carrier 16. In the inoperative position, the one end 25*a* of the guide bar 25 moves upward, so that a space above the print head 14 is widely opened, facilitating replacement of printing ribbon (not shown) or maintenance therethrough.

In FIG. 4, one end of the shaft 11 of the platen 10 projects outward from the side frame 12, and a large-diameter spur gear 30 is fixed on the projecting end. The large-diameter spur gear 30 is drivingly connected to a reversible motor 32 as a drive source by means of a small-diameter spur gear 31. The motor 32 is mounted on the side frame 12.

The large-diameter spur gear 30 is in mesh with another small-diameter spur gear 33, which is coupled to the guide shaft 22 by means of a one-way clutch 34.

The set of guide rollers 21 (four in number in this embodiment) are arranged at intervals along the longitudinal direction of the guide shaft 22, substantially covering the overall length of the platen 10.

The guide bar 25 includes guide arms 35 rockably supported at their proximal ends by the guide shaft 22 and a connecting bail 36 integrally coupled with the free ends of the arms 35 and extending parallel to the longitudinal direction of the platen 10. Thus, the operating levers 25*d* are formed individually on the guide arms 35, and the one end 25*a* of the guide bar 25 is formed by the guide bail 36.

The spring 26 is stretched between one end of the guide bail 36 and the side frame 12. Supported on the same guide shaft 22, the guide bar 25 and the guide rollers 21 can be mounted as a single unit on a printer.

Figure 5:
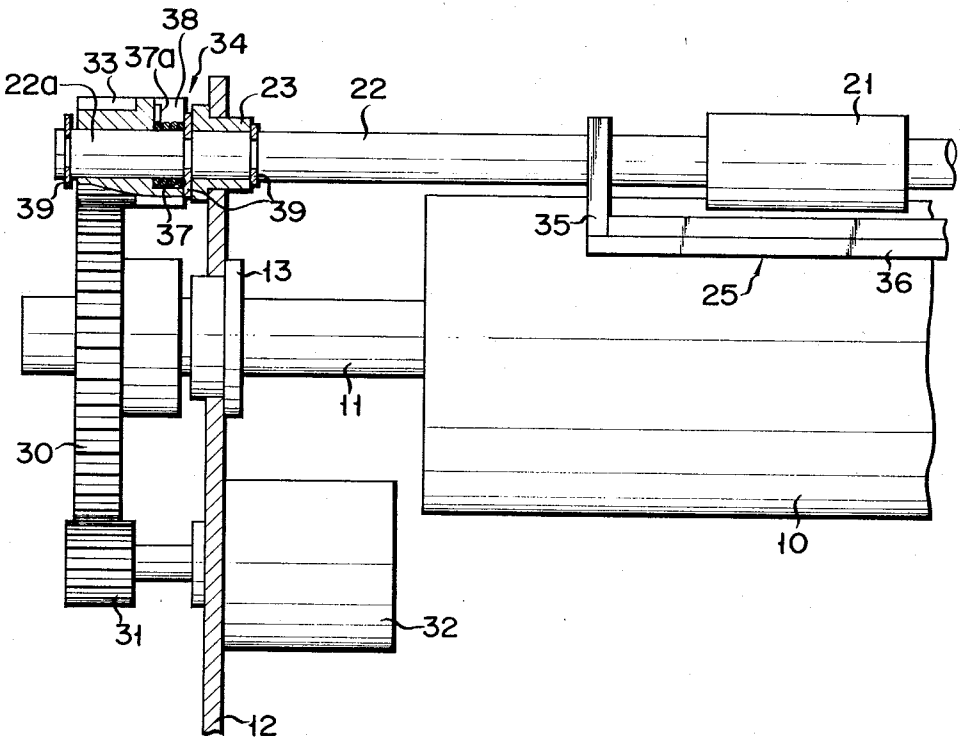
FIG. 5 is an enlarged view showing the principal part of the device of FIG. 4 including a one-way clutch.

Referring now to FIG. 5, the one-way clutch 34 will be described in detail. The one-way clutch 34 includes a clutch spring 37 wound on an extended shaft portion 22*a* of the guide shaft 22. One end 37*a* of the clutch spring 37 is fitted in and retained by a stop groove 38 formed on a gear 33 which is rotatably supported on the extended shaft portion 22*a*. The other end of the clutch spring 37 is wound on the extended shaft portion 22*a*. This is an arrangement of a conventional spring clutch.

One-way clutches of other conventional types, such as a roller type, may be used in place of the spring clutch.

When the platen 10 rotates in its forward feed direction (FIG. 3) for the record carrier 16, the one-way clutch 34 is engaged, so that the guide rollers 21 rotate in their forward feed direction. In this case, however, the rotating directions of the platen 10 and the guide rollers 21 are counterclockwise and clockwise, respectively, as indicated by full-line arrows in FIG. 3. These respective directions are coincident with the forward feed direction of the record carrier 16. Moreover, the small-diameter spur gear 33 and the large-diameter spur gear 30 have a correlation such that the guide rollers 21 rotate at a peripheral speed higher than that of the platen 10.

When the platen 10 rotates in the opposite direction to feed the record carrier 16 in a reverse feed direction, the clutch 34 is disengaged, so that the gear 33 slips on the extended shaft portion 22*a*. Thus, the guide rollers 21, along with the guide shaft 22, are kept nonrotating. To prevent the guide shaft 22 and the guide rollers 21 from idling, there is provided a means (not shown) for applying a small friction to them.

In FIG. 5, numeral 39 designates retaining rings fitted individually on the guide shaft 22 and its extended shaft portion 22*a*.

Figure 6:
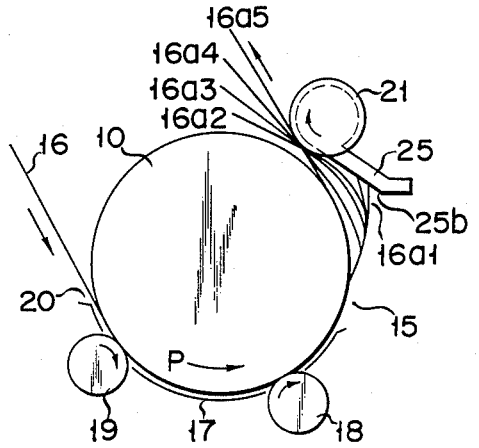
FIG. 6 is a schematic view of the device of the invention illustrating a mode in which a record carrier is fed in its forward feed direction.
Figure 7:
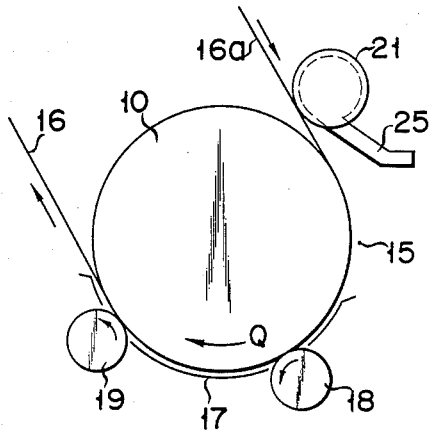
FIG. 7 is a schematic view of the device of the invention illustrating a mode in which the record carrier is fed in its reverse feed direction.

Referring now to FIGS. 6 and 7, the record carrier feed operation of the record carrier feed device with the above-mentioned construction will be described.

As shown in FIG. 6, the record carrier 16 inserted through the inlet aperture 20 is fed in the forward feed direction as the platen 10 rotates in the direction indicated by arrow P. The record carrier 16 then passes through the printing region 15, and its leading edge 16*a* moves upward, separating from the peripheral surface of the platen 10 in a direction tangential thereto. Thereupon, the leading edge 16*a* abuts against the slanting surface 25*b* of the guide bar 25, as indicated by $16a_1$. Moving in sliding contact with the slanting surface 25*b*, the leading edge 16*a* is delivered to the guide rollers 21. By frictional engagement with the peripheral surface of the guide rollers 21 rotating at high speed, the leading edge 16*a* is rapidly deformed by steps $16a_2$, $16a_3$, $16a_4$ and $16a_5$. When the step $16a_5$ is reached, the record carrier 16 comes into intimate contact with that portion of the peripheral surface of the platen 10 which fully covers the printing region 15. Since the peripheral speed of the guide rollers 21 is higher than that of the platen 10, the leading edge 16*a* of the record carrier 16 continues to be subjected to a tractive force in the forward feed direction from the guide rollers 21 caused by the difference between the two speeds. Thus, the intimate contact between the platen 10 and the record carrier 16 is promoted, protecting the record carrier 16 from troubles in feeding, such as dislocation, slacks or bulges.

If the platen 10 rotates reversely in the direction indicated by arrow Q, as shown in FIG. 7, the record carrier 16 is fed in the reverse direction, as indicated by the arrows in FIG. 7. In this case, however, the guide rollers 21 do not rotate since the one-way clutch 34 is disengaged. While the record carrier 16 is being fed reversely, therefore, its leading edge 16*a* is in frictional contact with the nonrotating guide rollers 21 and is continually pulled by a frictional force acting oppositely to the reverse feed direction. As a result, as in the case of the forward feeding, the intimate contact between the record carrier 16 and the peripheral surface of the platen 10 is secured in the printing region 15.

Thus, if the record carrier 16 is fed in either direction, the guide rollers 21 never fails to bring the record carrier 16 into intimate contact with the peripheral surface of the platen 10, so that the printer can satisfactorily fulfill its function in the so-called graphic printing.

The guide bar 25 serves to automatically guide the leading edge 16*a* of the record carrier 16 in the aforesaid manner when the record carrier 16 is reversely fed to a degree such that the leading edge 16*a* is disengaged from the guide rollers 21 and is then redirected toward the guide rollers 21 by forward feeding.

Accordingly, the operator can perform graphic printing or reverse feeding without limiting the feed distance. Thus, the automatic insertion of the record carrier 16 can securely be accomplished with ease.

The slanting surface 25*b* of the guide bar 25, which is straight in shape in the above described embodiment, may be replaced with a concave surface for smoother guiding action.

It is to be understood that the present invention is not limited to the above embodiment, and may also be applied to printers or typewriters of a daisy-wheel type, as well as the printers of the dot-matrix type.

What is claimed is:

1. A record carrier feed device comprising:

a platen rotatable about a first axis and having a cylindrical surface, said platen defining a printing region on the front side thereof;

a first drive means for rotating the platen at a first peripheral speed in a forward feed direction;

support means for directing the record carrier toward the printing region while holding, in cooperation with with platen, the record carrier aroung the platen as the platen rotates;

guide roller means disposed beside the platen above the printing region and rotatable about a second axis parallel to the first axis, said guide roller means having a roller peripheral surface capable of coming into frictional contact with the record carrier, said second axis being fixed relative to said first axis to define a gap between the roller peripheral surface of said guide roller means and the cylindrical surface of the platen, said gap having a predetermined size wide enough not to nip the record carrier between the platen and the guide roller means;

guide bar means disposed in a fixed position between the printing region and the guide roller means during insertion and feeding operations of the record carrier and having one end extending toward the printing region and the other end remote therefrom, said one end of the guide bar means being formed of a slanting surface which engages with the leading edge of the record carrier moving upward, separating from the peripheral surface of the platen at the printing region along the forward feed direction, thereby directing the leading edge of the record carrier toward the guide roller means; and second drive means for rotating the guide roller means at a second peripheral speed higher that the first peripheral speed of the platen.

2. The record carrier feed device according to claim 1, wherein the first drive means also rotates the platen in a reverse direction; and the record carrier feed device further comprises one-way clutch means adapted to drivingly connect the second drive means to the guide roller means in the forward feed direction and to disengage the second drive means from the guide roller means in the reverse feed direction.

3. The record carrier feed device according to claim 2, wherein said first and second drive means are connected drivingly.

4. The record carrier feed device according to claim 1, wherein the other end of said guide bar means is rockably supported on the second axis.

5. The record carrier feed device according to claim 4, wherein said guide bar means includes a number of guide arms arranged at intervals along the second axis and having their proximal ends rockably supported on the second axis, and a connecting bail fixedly connected to the free ends of the guide arms and extending parallel to the second axis, and said guide roller means includes a number of guide rollers arranged individually between the guide arms.

6. The record carrier feed device according to claim 4, wherein said guide bar means is rockable between an operative position where the one end thereof is located close to the cylindrical surface of the platen and an inoperative position where the one end is remote from the cylindrical surface, said guide bar means having thereon an operating lever for the rocking operation thereof.

7. The record carrier feed device according to claim 1, further comprising spring means for urging the guide bar means toward an operative position to guide the record carrier and stop means for locating the guide bar means in the operative position against the urging force of the spring means.

8. The record carrier feed device according to claim 1, wherein the gap between the roller peripheral surface of said guide roller means and the cylindrical surface of the platen is set at about 2.00 mm in width.

* * * * *

UNITED STATES PATENT AND TRADEMARK OFFICE

CERTIFICATE OF CORRECTION

PATENT NO. : 4,666,322

DATED : May 19, 1987

INVENTOR(S) : Masahiro Mitani

Figure 1:
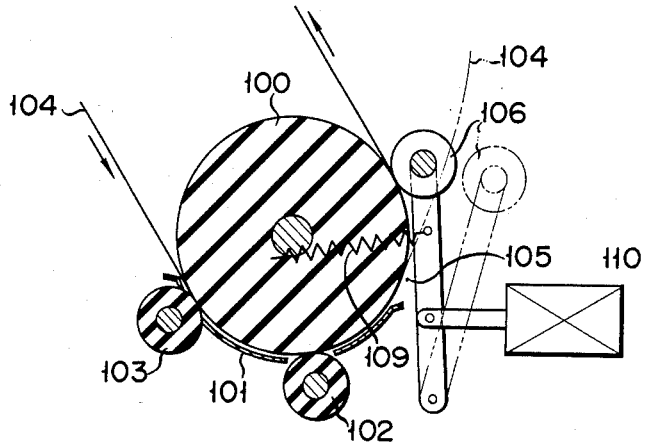
FIG. 1 (PRIOR ART)
FIG. 1 is a vertical sectional view of a prior art record carrier feed device including a cross-sectional view of a platen.
Figure 2:
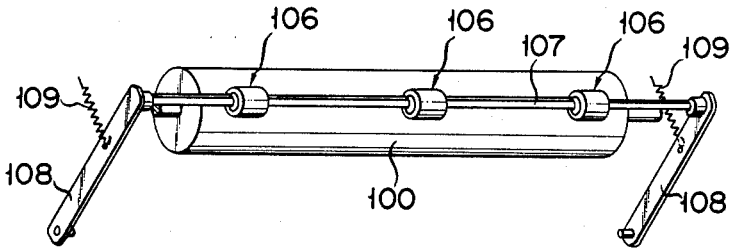
FIG. 2 (PRIOR ART)
FIG. 2 is a perspective view showing the principal part of the prior art device of FIG. 1.

It is certified that error appears in the above-identified patent and that said Letters Patent is hereby corrected as shown below:

Claim 1, column 7, line 19, "a" (first occurrence) should be deleted;
line 23, "with" (first occurrence) should be deleted,
and "aroung" should be --around--; and
column 8, line 4, "that" should be --than--.
Fig. 1, a lead line for solenoid 110 should be added.

Signed and Sealed this

Seventeenth Day of May, 1988

*Attest:*

DONALD J. QUIGG

*Attesting Officer*

*Commissioner of Patents and Trademarks*